US010244828B2

(12) United States Patent
Wang

(10) Patent No.: US 10,244,828 B2
(45) Date of Patent: Apr. 2, 2019

(54) WIDE TOP NARROW BOTTOM TYPE DOUBLE-LAYER ZIPPER FOR LUGGAGE AND ZIPPER SLIDER FOR SAME

(71) Applicant: GENMORE ZIPPER CORPORATION, New Taipei (TW)

(72) Inventor: Lien-Chou Wang, New Taipei (TW)

(73) Assignee: GENMORE ZIPPER CORPORATION, New Taipei (TW)

( * ) Notice: Subject to any disclaimer, the term of this patent is extended or adjusted under 35 U.S.C. 154(b) by 289 days.

(21) Appl. No.: 15/346,866

(22) Filed: Nov. 9, 2016

(65) Prior Publication Data

US 2018/0125176 A1 May 10, 2018

(51) Int. Cl.

| | |
|---|---|
| ***A44B 19/12*** | (2006.01) |
| ***A45C 13/10*** | (2006.01) |
| ***A44B 19/40*** | (2006.01) |

(52) U.S. Cl.

CPC ..... *A44B 19/12* (2013.01); *A44B 19/406* (2013.01); *A45C 13/103* (2013.01)

(58) Field of Classification Search

CPC ..... A44B 19/12; A44B 19/406; A44B 19/32; A45C 13/103; Y10T 24/2523; Y10T 24/2561

See application file for complete search history.

(56) References Cited

U.S. PATENT DOCUMENTS

| | | | | |
|---|---|---|---|---|
| 1,926,217 A * | 9/1933 | Trotter | A44B 19/12 | 24/391 |
| 4,601,085 A * | 7/1986 | Yoshida | A44B 19/32 | 24/384 |
| 8,438,705 B2 * | 5/2013 | Wang | A44B 19/32 | 24/394 |
| 8,793,847 B2 * | 8/2014 | Chung | A44B 19/382 | 24/382 |
| 2004/0025307 A1 * | 2/2004 | Wu | A44B 19/12 | 24/396 |

(Continued)

FOREIGN PATENT DOCUMENTS

| | | | |
|---|---|---|---|
| EP | 2692260 * | 11/2016 | A44B 19/12 |
| WO | WO-2013094335 A1 * | 6/2013 | A44B 19/12 |

*Primary Examiner* — Victor D Batson
*Assistant Examiner* — Matthew J Sullivan
(74) *Attorney, Agent, or Firm* — Jackson IPG PLLC; Demian K. Jackson

(57) ABSTRACT

A wide top narrow bottom type double-layer zipper that the width of the interlocked bottom interlocking coils is smaller than the width of the interlocked top interlocking coils; the top interlocking coils and the bottom interlocking coils have the same spiral pitch; the top and bottom layers of the wide top narrow bottom type double-layer zipper are vertically aligned and sewed; the diameter of the polyester coils extend spirally around the respective filler cords of the respective bottom interlocking coils monofilament is about 0.02 mm~0.1 mm smaller than the diameter of the polyester coils monofilament that extend spirally around the respective filler cords of the respective top interlocking coils; the engaged tooth line of the top interlocking coils at the top cover panel of the zipper slider and the engaged tooth line of the bottom interlocking coils at the bottom cover panel of the zipper slider exhibit a non-superimposed relationship.

5 Claims, 9 Drawing Sheets

(56) References Cited

U.S. PATENT DOCUMENTS

| | | | | |
|---|---|---|---|---|
| 2013/0104348 | A1* | 5/2013 | Wang | A44B 19/12<br>24/392 |
| 2015/0223572 | A1* | 8/2015 | Wang | A44B 19/26<br>24/428 |
| 2016/0198812 | A1* | 7/2016 | Tan | A44B 19/22<br>24/389 |
| 2017/0251771 | A1* | 9/2017 | Wang | A45C 13/103 |

* cited by examiner

WIDE TOP NARROW BOTTOM TYPE DOUBLE-LAYER ZIPPER FOR LUGGAGE AND ZIPPER SLIDER FOR SAME

BACKGROUND OF THE INVENTION

1. Field of the Invention

The present invention relates to zip fastener technology, and more particularly, to a wide top narrow bottom type double-layer zipper for luggage and zipper slider for same, which enables the zipper slider to be pulled smoothly with less effort, prolonging the lifespan of the zipper.

2. Description of the Related Art

Luggage is a travel friendly container for containing your possessions when you are travelling. With the development of tourism, people use luggage more and more frequently. Further, polyester zippers are intensively used in luggage so that the user can open or close the luggage conveniently. However, the interlocked interlocking teeth (coils) of a single-layer zipper can easily be opened by a pen tip, cone point or any other pointed object. Therefore, the anti-theft performance of a single-layer zipper is poor, and the storage items in the luggage can easily be stolen by a theft. There is known a conventional double-layer zipper 10 (see FIG. 1), which comprises left and right zipper tapes 101, two top interlocking coils 102 and two bottom interlocking coils 103 respectively stitched to the opposing top and bottom walls of the left and right zipper tapes 101. The top interlocking coils 102 and the bottom interlocking coils 103 have the same width B' and the same specifications, and are inserted through a zipper slider, as illustrated in FIG. 2. Further, Chinese Patent ZL201210039575.5 discloses a sandwich type polyester double-layer zipper and zipper slider, and a hot pressing and shaping method for the fabrication of same. This design of double-layer zipper can prevent explosion of the interlocked interlocking coils, however, when this design of double-layer zipper is used in a hard shell luggage and stitched to a curved turning corner area, the sandwich stitching arrangement of the same width top and bottom interlocking coils can cause the zipper slider to twist or to turn at an angle, and the widest part of the bottom cover panel of the zipper slider 20 will touch and rub against the inner edges 301 of the N type plastic packing strips 30 (see FIG. 2), producing friction resistance and affecting the use of the luggage.

U.S. Pat. Nos. 8,707,524, 8,438,705 and US 2013/0104348A1, invented by the present inventor, disclose similar double-layer zippers. Other double-layer zipper designs are seen in U.S. Pat. Nos. 4,601,085, 8,793,847, US2010/0269311A1 and German DE112012005338T5. According to these double-layer zipper designs, the top interlocking coils and the bottom interlocking coils are identical in width. If a double-layer zipper of this kind is stitched to a smoothly arched corner area of a luggage, pulling the zipper slider will encounter a large resistance. When pulling the zipper slider, the zipper slider can be forced to bias and to rub with the widest part of the bottom cover panel thereof against the edges of the left and right N type plastic packing strips, affecting the sliding smoothness of the zipper slider and the use of the luggage. U.S. Pat. No. 4,061,085 discloses a waterproof type double-layer zipper. This design of double-layer zipper provides good waterproof effects, however, in order to achieve better waterproof effects, the zipper tapes and the interlayer are made to have a large thickness and the side edges of the zipper tapes protrude over the outer sides of the interlocking teeth (coils) a certain distance, the user cannot pull the zipper slider smoothly with less effort. When pulling the zipper slider, inside wall of the zipper slider will be forced to rub against the interlocking teeth (coils). Thus, the interlocking teeth (coils) will wear quickly with use, shortening the lifespan of the zipper. Further, according to the design of the double-layer zipper of U.S. Pat. No. 4,061,085, the soft coating greatly increases the thickness of the zipper tapes and affects the structural stability of the zipper. When pulling the zipper slider, a large resistance will be produced, and the top and bottom interlocking teeth (coils) can easily be squeezed or biased, affecting engagement. If a hard coating is used to substitute for the soft coating, the sliding movement of the zipper slider will be more difficult. Thus, this design of double-layer zipper can simply be used in diving suits, not suitable for use in other waterproof articles. Further, in the use of the aforesaid various prior art double-layer zippers, the lower half of the zipper slider will rub against the N type plastic packing strips of the luggage, producing large friction resistance. More particularly, if the double-layer polyester zipper of U.S. Pat. No. 8,793,847 is stitched to a turning corner of a luggage, the zipper tapes can be twisted when the zipper slider is being pulled, affecting the sliding movement of the zipper slider.

SUMMARY OF THE INVENTION

The present invention has been accomplished under the circumstances in view. It is the main object of the present invention to provide a wide top narrow bottom type double-layer zipper for luggage and zipper slider for same, which has a simple structure, facilitating smooth sliding operation of the zipper slider and ensuring a high level of security.

It is another object of the present invention to provide a wide top narrow bottom type double-layer zipper for luggage and zipper slider for same, which is so designed that the width of the interlocked bottom interlocking coils is smaller than the width of the interlocked top interlocking coil, and, the width of the bottom cover panel is relatively smaller than the width of the top cover panel, and thus, the gap between the bottom cover panel of the zipper slider and each N type plastic packing strip of the luggage is relatively enlarged, avoiding contact friction between the zipper slider and the N type plastic packing strips and facilitating sliding movement of the zipper slider.

It is still another object of the present invention to provide a wide top narrow bottom type double-layer zipper for luggage and zipper slider for same, which is so designed that the diameter of the polyester coils that extend spirally around the respective filler cords of the respective bottom interlocking coils monofilament is about 0.02 mm~0.1 mm smaller than the diameter of the polyester coils that extend spirally around the respective filler cords the respective top interlocking coils monofilament, the gap between the polyester coils of the bottom interlocking coils will be relatively larger than the gap between the polyester coils of the top interlocking coils if the top and bottom interlocking coils are configured to have the same spiral pitch. Subject to the design that the gap between the polyester coils of the bottom interlocking coils is relatively larger than the gap between the polyester coils of the top interlocking coils, the invention prevents squeezing between the bottom interlocking coils and minimizes the gap difference between the top and bottom interlocking coils if the wide top narrow bottom type double-layer zipper is mounted in a curved turning corner area of a luggage, and thus, the zipper slider can be pulled smoothly around the curved corner area.

It is still another object of the present invention to provide a wide top narrow bottom type double-layer zipper for luggage and zipper slider for same, which is so designed that the filler cords of the top and bottom interlocking coils or the top and bottom interlocking coils exhibit different colors for quick identification, avoiding installation errors.

It is still another object of the present invention to provide a wide top narrow bottom type double-layer zipper for luggage and zipper slider for same, which is so designed that the engaged tooth lines of the top and bottom interlocking coils are not superimposed on each other so that the interlocking time and location of the top interlocking coils can be different from the bottom interlocking coils; the non-superimposed relationship between the engaged tooth lines of the top and bottom interlocking coils enables the top interlocking coils and the bottom interlocking coils to be forced into engagement at different time points and different locations, so that the zipper slider will receive less resistance when it is pulled, prolonging the lifespan of the zipper.

It is still another object of the present invention to provide a wide top narrow bottom type double-layer zipper for luggage and zipper slider for same, which is so designed that the width of the interlocked bottom interlocking coils is smaller than the width of the interlocked top interlocking coils and the width of the bottom cover panel is smaller than the width of the top cover panel, and thus, the zipper slider can be pulled smoothly with less effort no matter that the wide top narrow bottom type double-layer zipper is stitched to the luggage along a straight line or curved turning corner area, prolonging the lifespan of the zipper.

It is still another object of the present invention to provide a wide top narrow bottom type double-layer zipper for luggage and zipper slider for same, which maintains the advantages of a double-layer zipper and provides the feature that the width of the interlocked bottom interlocking coils is smaller than the width of the interlocked top interlocking coils and the feature that the width of the bottom cover panel is smaller than the width of the top cover panel, the zipper slider can be pulled smoothly with less effort no matter that the wide top narrow bottom type double-layer zipper is stitched to the luggage along a straight line or curved turning corner area, and thus, the installation of the wide top narrow bottom type double-layer zipper can be done using a regular industrial sewing machine, saving the cost.

DETAILED DESCRIPTION OF THE INVENTION

Figure 1:
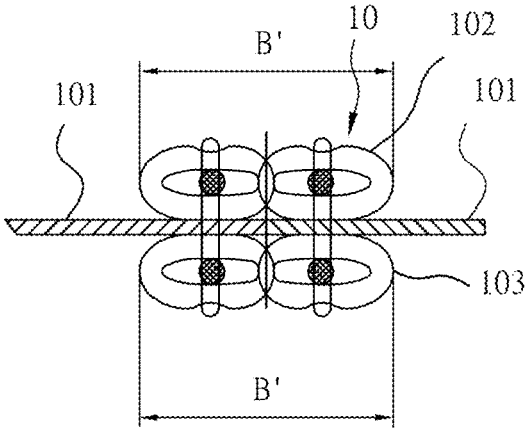
Fig. 1 PRIOR ART
FIG. 1 is a schematic top view of a double-layer zipper according to the prior art.
Figure 2:
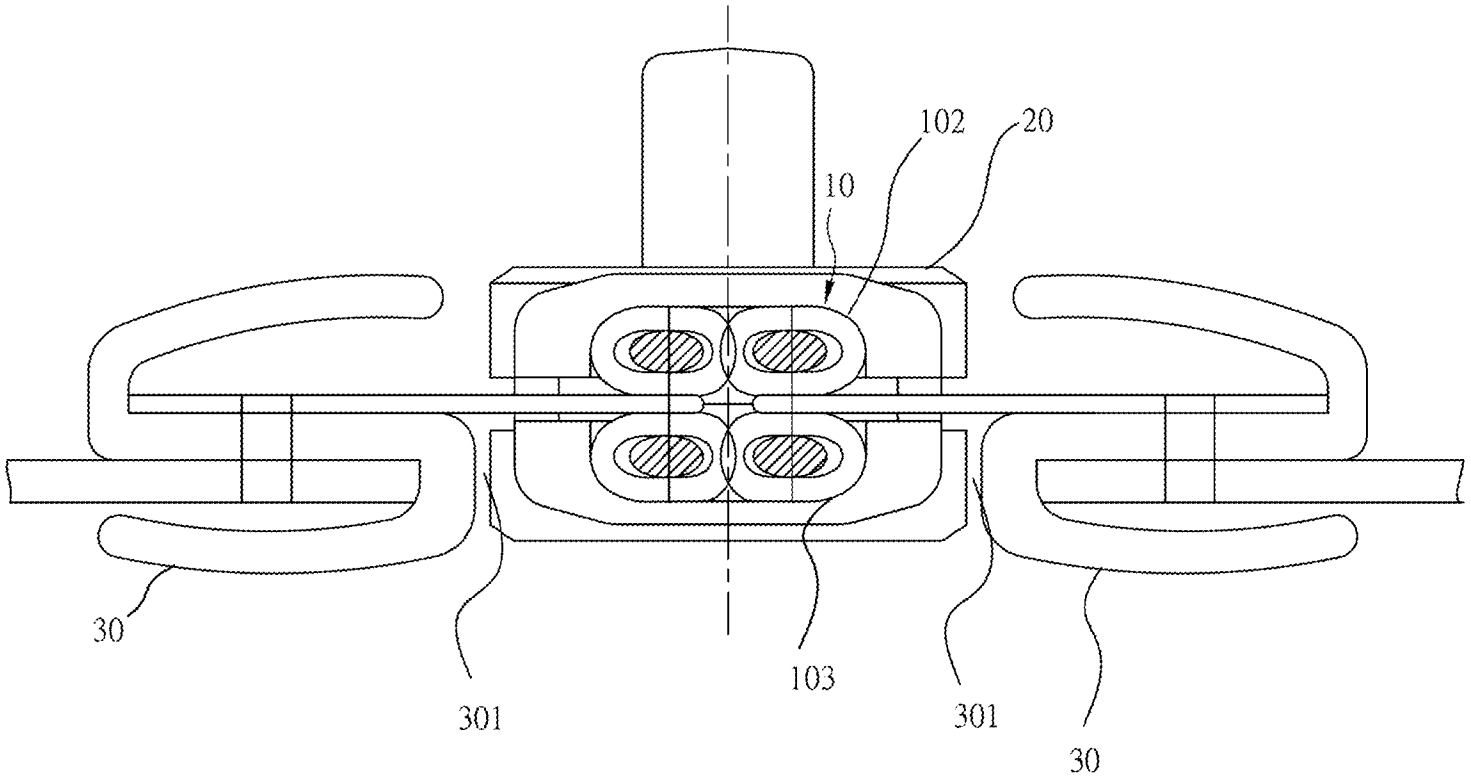
Fig. 2 PRIOR ART
FIG. 2 is a schematic sectional view, illustrating a double-layer zipper mounted in a luggage according to the prior art.
Figure 3:
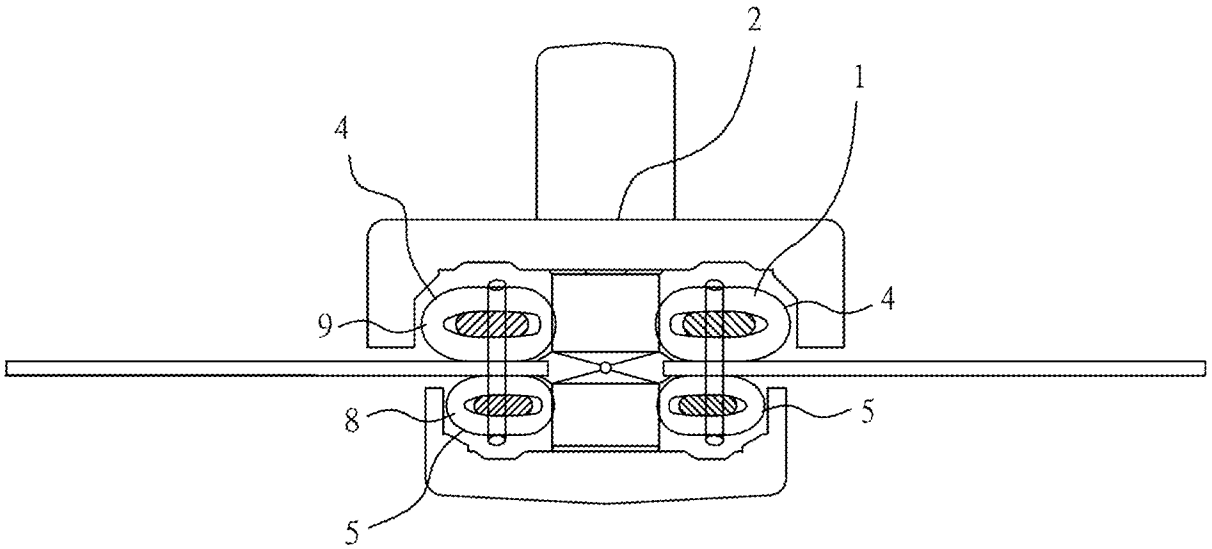
FIG. 3 is a schematic sectional view of a wide top narrow bottom type double-layer zipper for luggage in accordance with the present invention.
Figure 4:
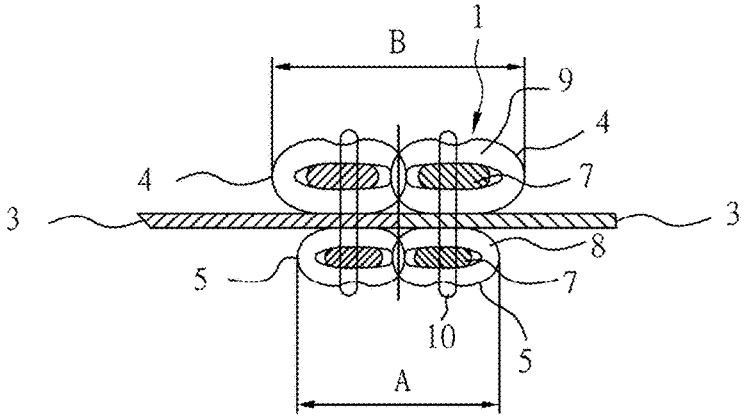
FIG. 4 is a schematic sectional view, illustrating the top and bottom zipper set of the wide top narrow bottom type double-layer zipper in accordance with the present invention.
Figure 5:
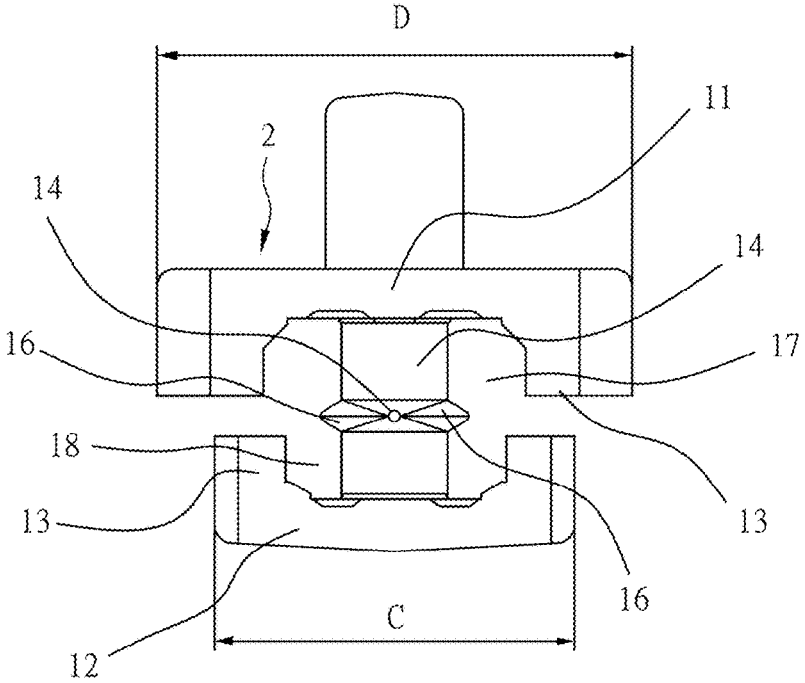
FIG. 5 is a schematic front view of the zipper slider of the wide top narrow bottom type double-layer zipper in accordance with the present invention.
Figure 6:
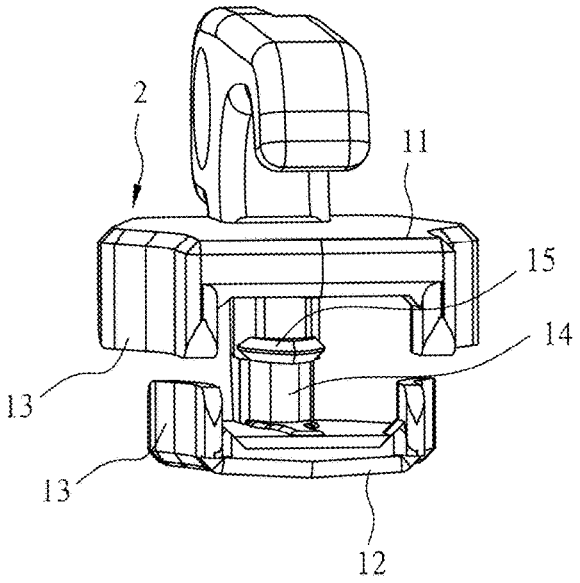
FIG. 6 is an oblique front elevational view of the zipper slider of the wide top narrow bottom type double-layer zipper in accordance with the present invention.
Figure 7:
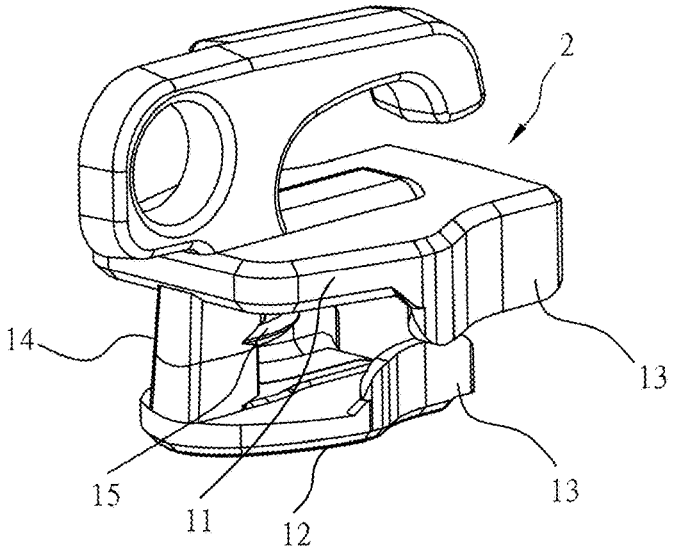
FIG. 7 is an oblique rear elevational view of the zipper slider of the wide top narrow bottom type double-layer zipper in accordance with the present invention.
Figure 8:
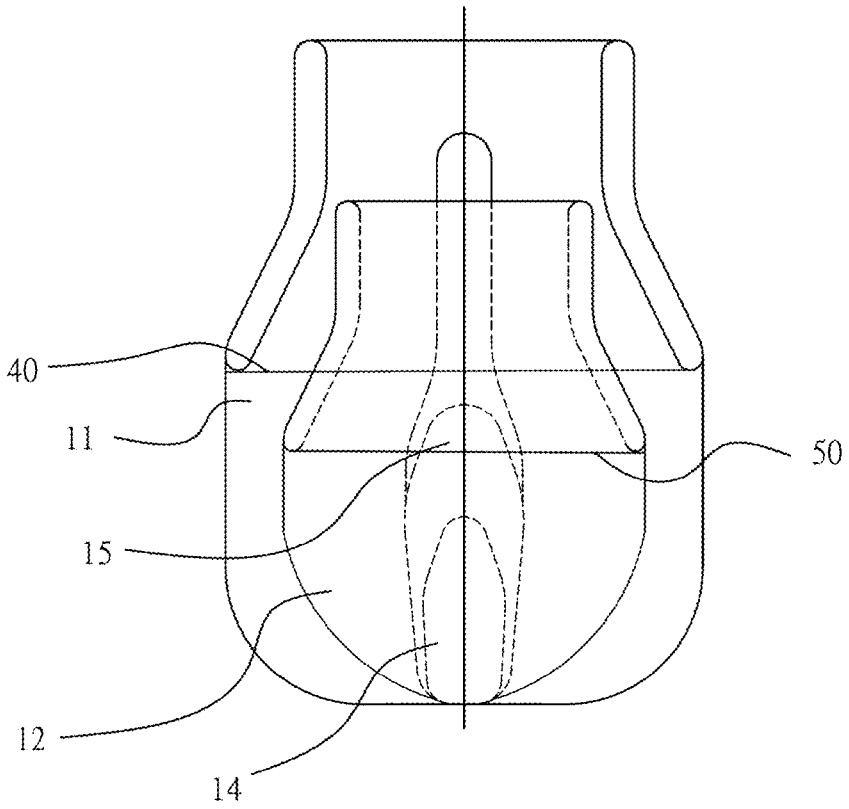
FIG. 8 is a bottom view of the zipper slider of the wide top narrow bottom type double-layer zipper in accordance with the present invention.
Figure 9:
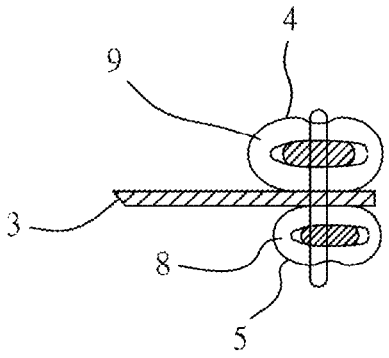
FIG. 9 is a schematic sectional view of the left half of the top and bottom zipper set of the wide top narrow bottom type double-layer zipper in accordance with the present invention.
Figure 10:
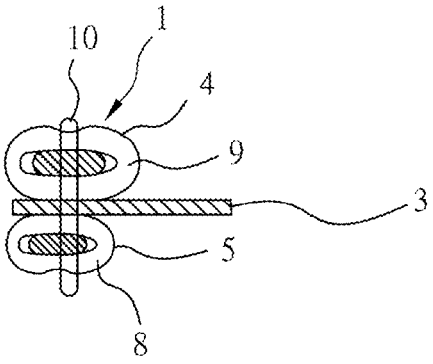
FIG. 10 is a schematic sectional view of the right half of the top and bottom zipper set of the wide top narrow bottom type double-layer zipper in accordance with the present invention.
Figure 11:
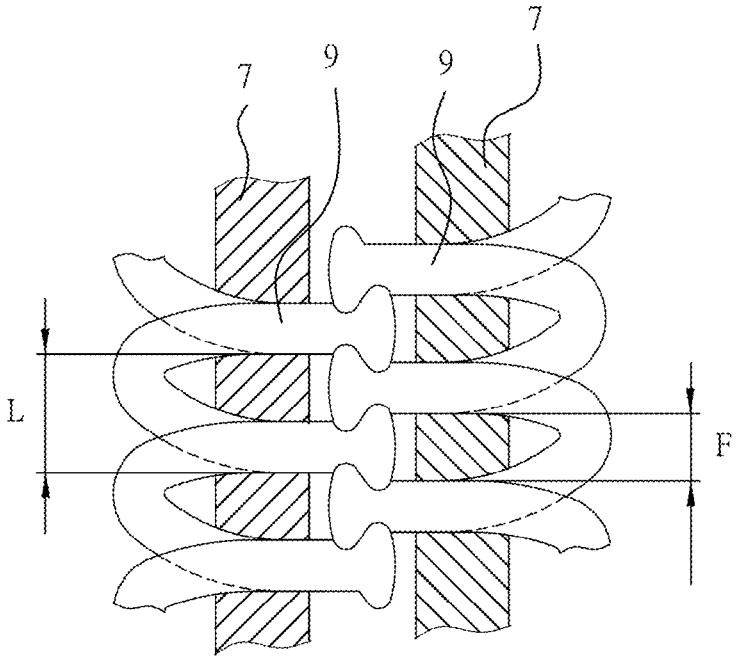
FIG. 11 is a schematic top view, in an enlarged scale, of a part of the present invention, illustrating the top interlocking coils interlocked.

The invention provides a wide top narrow bottom type double-layer zipper for luggage and zipper slider for same. As illustrated in FIG. 3, the wide top narrow bottom type double-layer zipper comprises a top and bottom zipper set 1 (see FIG. 4), and a zipper slider 2 (see FIGS. 5-8) coupled to the top and bottom zipper set 1 and movable in one of two reversed directions to close or open the zipper set 1. The top and bottom zipper set 1 comprises left and right zipper tapes 3 (see FIG. 4), top and bottom interlocking coils 4,5 stitched to the opposing top and bottom surfaces of the left and right zipper tapes 3 to form two left series of interlocking teeth (see FIG. 9) and two right series of interlocking teeth (see FIG. 10). The top and bottom interlocking coils 4,5 each comprise a filler cord 7, and a polyester coil monofilament 8,9 spirally extended around the filler cord 7 (see FIG. 11). The filler cords 7 of the top and bottom interlocking coils 4,5 (see FIG. 4) and/or the top and bottom interlocking coils 4,5 can be made in different colors for quick identification between the positive (front) side and the negative (back) side. The diameter of the polyester coils monofilament 8 that extend spirally around the respective filler cords 7 of the respective bottom interlocking coils monofilament 8 (see FIG. 4) is about 0.02 mm~0.1 mm smaller than the diameter of the polyester coils monofilament 9 that extend spirally around the respective filler cords 7 of the respective top interlocking coils 4. The top interlocking coils 4 can be standard interlocking coils such as interlocking coils for #7, #8 or #10 zippers. The width A of the interlocked bottom interlocking coils 5 (see FIG. 4) is shorter than the width B of the interlocked top interlocking coils 4 (see FIG. 4). Further, the top and bottom interlocking coils 4,5 have the same spiral pitch L (see FIG. 11). The top and bottom layers of the wide top narrow bottom type double-layer zipper are vertically aligned and sewed, ensuring that when stitching the top and bottom interlocking coils 4,5 to the zipper tapes 3, the stitching needle and the thread 10 can be smoothly inserted through the gaps F in the top and bottom interlocking coils 4,5 (see FIG. 11) across the zipper tapes 3. The zipper slider 2 (see FIG. 5) comprises a top cover panel 11, an opposing bottom cover panel 12, opposing side guard flanges 13 respectively and perpendicularly located at respective opposite lateral sides of the top cover panel 11 and the bottom cover panel 12, an upright base center 14 connected between the top cover panel 11 and the bottom cover panel 12 (see FIG. 5) on the middle, and a tongue plate 15 perpendicularly extended from the upright base center 14 and spaced between the top cover panel 11 and the bottom cover panel 12 for separating and guiding the top and bottom interlocking coils 4,5. The tongue plate 15 comprises 4 arched guide surfaces 16 bilaterally located on opposing top and bottom walls thereof for mating with the top and bottom interlocking coils 4,5 (see FIG. 5). The left and right side guard flanges 13 at the top cover panel 11 and the bottom cover panel 12 respectively defined therebetween a respective bell mouth. The open ends of the bell mouths are respectively disposed corresponding to the engaged tooth line 40,50 of the top and bottom interlocking coils (see FIG. 8). Further, the engaged tooth line 40 of the top interlocking coils 4 at the top cover panel 11 and the engaged tooth line 50 of the bottom interlocking coils 5 at the bottom cover panel 12 are not superimposed (see FIG. 8). As illustrated in FIG. 8, the engaged tooth line 50 of the bottom interlocking coils 5 is disposed at a front side relative to the engaged tooth line 40 of the front interlocking coils 4. In an alternate form of the present invention, the engaged tooth line 50 of the bottom interlocking coils 5 is disposed at a back side relative to the engaged tooth line 40 of the front interlocking coils 4. The tongue plate 15 and the top cover panel 11 define therebetween a top chamber 17 for accommodating the top interlocking coils 4 (see FIG. 5). The tongue plate 15 and the bottom cover panel 12 define therebetween a bottom chamber 18 for accommodating the bottom interlocking coils 5 (see FIG. 5). The width C of the bottom cover panel 12 is smaller than the width D of the top cover panel 11. Further, the bottom chamber 18 is relatively narrower and shorter than the top chamber 17. Further, the bottom chamber 18 and the top chamber 17 are symmetric.

Figure 12:
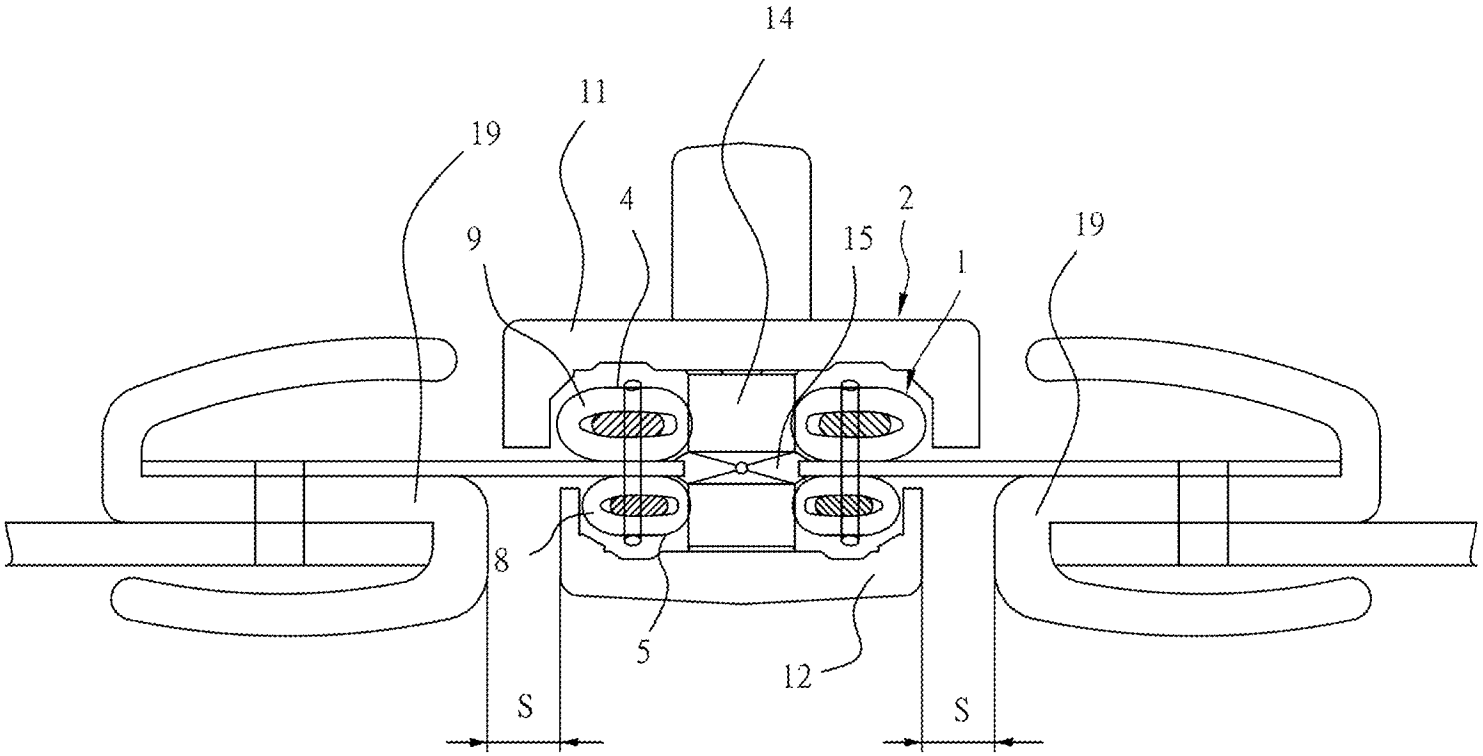
FIG. 12 is a schematic installed view of the present invention, illustrating the wide top narrow bottom type double-layer zipper stitched to a luggage in accordance with the present invention.

In application, the top and bottom zipper set 1 of the wide top narrow bottom type double-layer zipper is stitched to a luggage. As illustrated in FIG. 12, the width of the bottom cover panel 12 is shorter than the width of the top cover panel 11, thus, the gap S between the bottom cover panel 12 of the zipper slider 2 and each N type plastic packing strip 19 of the luggage is much larger than that in the prior art design, avoiding contact friction.

In conclusion, the invention has the features and advantages as follows:

1. The width A of the interlocked bottom interlocking coils 5 is smaller than the width B of the interlocked top interlocking coil 4, and, the width C of the bottom cover panel 12 is relatively smaller than the width D of the top cover panel 11, thus, the gap S between the bottom cover panel 12 of the zipper slider 2 and each N type plastic packing strip 19 of the luggage is relatively enlarged, avoiding contact friction between the zipper slider 2 and the N type plastic packing strips 19 and facilitating sliding movement of the zipper slider 2.

2. Due to that the diameter of the polyester coils monofilament 8 that extend spirally around the respective filler cords 7 of the respective bottom interlocking coils monofilament 8 is about 0.02 mm~0.1 mm smaller than the diameter of the polyester coils monofilament 9 that extend spirally around the respective filler cords 7 of the respective top interlocking coils 4, the gap between the polyester coils monofilament 8 of the bottom interlocking coils 5 will be relatively larger than the gap between the polyester coils monofilament 9 of the top interlocking coils 4 if the top and bottom interlocking coils 4,5 are configured to have the same spiral pitch L. Under this condition, when the wide top narrow bottom type double-layer zipper is stitched to a turning corner area of the luggage, the top and bottom layers of the top and bottom zipper set 1 will have different curvatures, the relatively smaller radius of curvature of the bottom interlocking coils 5 will cause the zipper to curve downwards, and thus, the top interlocking coils 4 will be stretched and the bottom interlocking coils 5 will be compressed, leading to shortened tooth pitch of the bottom interlocking coils 5 and squeezing between the interlocking coils and affecting the sliding smoothness of the zipper slider. The invention is so configured that the gap between the polyester coils monofilament 8 of the bottom interlocking coils 5 is relatively larger than the gap between the polyester coils monofilament 9 of the top interlocking coils 4, preventing squeezing between the bottom interlocking coils 5 and minimizing the gap difference between the top and bottom interlocking coils 4,5, and thus, the zipper slider 2 can be pulled smoothly around the curved corner area.

3. The filler cords 7 of the top and bottom interlocking coils 4,5 or the top and bottom interlocking coils 4,5 exhibit different colors for quick identification, avoiding installation errors.

4. The engaged tooth lines 40,50 of the top and bottom interlocking coils 4,5 are not superimposed on each other so that the interlocking time and location of the top interlocking coils 4 can be different from the bottom interlocking coils 5 (at the initial stage as the interlocking coils are forced into engagement, the zipper slider encounters the largest resistance; as the top and bottom interlocking coils of a conventional double-layer zipper are identical, the engaged tooth line of the top interlocking coils and the engaged tooth line of the bottom interlocking coils are superimposed on each other, and thus, the zipper slider encounters a resistance twice the resistance produced in driving the interlocking coils of a single layer zipper into engagement). The non-superimposed relationship between the engaged tooth lines 40,50 of the top and bottom interlocking coils 4,5 enables the top interlocking coils and the bottom interlocking coils to be forced into engagement at different time points and different locations, so that the zipper slider 2 will receive less resistance when it is pulled, prolonging the lifespan of the zipper.

5. The invention maintains the advantages of a double-layer zipper. Subject to the feature that the width A of the interlocked bottom interlocking coils 5 is smaller than the width B of the interlocked top interlocking coils 4 and the feature that the width C of the bottom cover panel 12 is smaller than the width D of the top cover panel 11, the zipper slider 2 can be pulled smoothly with less effort no matter that the wide top narrow bottom type double-layer zipper is stitched to the luggage along a straight line or curved turning corner area. The installation of the wide top narrow bottom type double-layer zipper can be done using a regular industrial sewing machine, saving the cost.

Although a particular embodiment of the invention has been described in detail for purposes of illustration, various modifications and enhancements may be made without departing from the spirit and scope of the invention. For example, the technical features of the present invention can be employed to create a narrow top wide bottom type double-layer zipper. Accordingly, the invention is not to be limited except as by the appended claims.

What is claimed is:

1. A wide top narrow bottom type double-layer zipper, comprising a top and bottom zipper set, and a zipper slider coupled to said top and bottom zipper set and movable in one of two opposite directions to close or open said top and bottom zipper set, said top and bottom zipper set comprising left and right zipper tapes, top and bottom interlocking coils stitched to opposing top and bottom surfaces of said left and right zipper tapes to form two left series of interlocking teeth and two right series of interlocking teeth, said top and bottom interlocking coils each comprising a filler cord and a polyester coil spirally extended around said filler cord, wherein:

the combined width of the interlocked said bottom interlocking coils is smaller than the combined width of the interlocked said top interlocking coils; said top interlocking coils and said bottom interlocking coils have the same spiral pitch; the top and bottom layers of the wide top narrow bottom type double-layer zipper are vertically aligned and sewed;

said zipper slider comprises a top cover panel, an opposing bottom cover panel, opposing left and right guard flanges respectively and perpendicularly located at respective opposite lateral sides of said top cover panel and said bottom cover panel, an upright base center connected between said top cover panel and said bottom cover panel on the middle, a top chamber defined by said top cover panel for accommodating said top interlocking coils and a bottom chamber defined by said bottom cover panel for accommodating said bottom interlocking coils, the width of said bottom cover panel being smaller than the width of said top cover panel, said bottom chamber being relatively narrower and shorter than said top chamber.

2. The wide top narrow bottom type double-layer zipper as claimed in claim 1, wherein the said filler cords of said top interlocking coils and the said filler cords of said bottom interlocking coils exhibit different colors for identification.

3. The wide top narrow bottom type double-layer zipper as claimed in claim 1, wherein said zipper slider further comprises a tongue plate perpendicularly extended from said upright base center and spaced between said top cover panel and said bottom cover panel for separating and guiding said top interlocking coils and said bottom interlocking coils, said tongue plate comprising arched guide surfaces bilaterally located on opposing top and bottom walls thereof for mating with said top interlocking coils and said bottom interlocking coils.

4. The wide top narrow bottom type double-layer zipper as claimed in claim 1, wherein the said left and right guard flanges at said top cover panel and the said left and right guard flanges at said bottom cover panel respectively defined therebetween a respective bell mouth, the said bell mouths being respectively disposed corresponding to respective engaged tooth lines of the interlocked said top interlocking coils and the interlocked said bottom interlocking coils, the engaged tooth line of said top interlocking coils at said top cover panel and the engaged tooth line of said bottom interlocking coils at said bottom cover panel exhibiting a non-superimposed relationship.

5. A wide top narrow bottom type double-layer zipper, comprising a top and bottom zipper set, and a zipper slider coupled to said top and bottom zipper set and movable in one of two opposite directions to close or open said top and bottom zipper set, said top and bottom zipper set comprising left and right zipper tapes, top and bottom interlocking coils stitched to opposing top and bottom surfaces of said left and right zipper tapes to form two left series of interlocking teeth and two right series of interlocking teeth, said top and bottom interlocking coils each comprising a filler cord and a polyester coil spirally extended around said filler cord, wherein:

the combined width of the interlocked said bottom interlocking coils is smaller than the combined width of the interlocked said top interlocking coils; said top interlocking coils and said bottom interlocking coils have the same spiral pitch; the top and bottom layers of the wide top narrow bottom type double-layer zipper are vertically aligned and sewed; the diameter of the said polyester coils that extend spirally around the respective said filler cords of the respective said bottom interlocking coils monofilament is about 0.02 mm~0.1 mm smaller than the diameter of the said polyester coils monofilament that extend spirally around the respective said filler cords of the respective said top interlocking coils;

said zipper slider comprises a top cover panel, an opposing bottom cover panel, opposing left and right guard flanges respectively and perpendicularly located at respective opposite lateral sides of said top cover panel and said bottom cover panel, an upright base center connected between said top cover panel and said bottom cover panel on the middle, a top chamber defined by said top cover panel for accommodating said top interlocking coils and a bottom chamber defined by said bottom cover panel for accommodating said bottom interlocking coils, the width of said bottom cover panel being smaller than the width of said top cover panel, said bottom chamber being relatively narrower and shorter than said top chamber.

* * * * *